US005193817A

United States Patent [19]

Pan

[11] Patent Number: 5,193,817

[45] Date of Patent: Mar. 16, 1993

[54] DART GAME

[76] Inventor: Francis Pan, No. 7, Ta-Tun 15th St., Nan-Tun Dist., Taichung City, Taiwan

[21] Appl. No.: 812,806

[22] Filed: Dec. 24, 1991

[51] Int. Cl.[5] ..... F41J 5/04

[52] U.S. Cl. ..... 273/376

[58] Field of Search ..... 273/371-377, 273/403, 407, 408

[56] References Cited

U.S. PATENT DOCUMENTS

| | | | |
|---|---|---|---|
| 2,179,471 | 11/1939 | Lee | 273/403 |
| 4,057,251 | 11/1977 | Jones et al. | 273/376 |
| 4,586,716 | 5/1986 | Brejcha et al. | 273/376 |
| 4,836,556 | 6/1989 | DeVale et al. | 273/376 |

*Primary Examiner*—Benjamin H. Layno
*Attorney, Agent, or Firm*—Birch, Stewart, Kolasch & Birch

[57] ABSTRACT

A dart game includes a dart and a dart board. The dart board includes a base plate, a target frame fixed to the base plate, and an automatic scoring register mounted between the target frame and the base plate. The target frame has a target portion including a plurality of target plates formed with blind counterbores for receiving the dart when the dart strikes the target portion. The target plate shifts rearwardly upon being struck by the dart to impact one of the membrane switches of the automatic scoring register so as to show a score on a display unit of the automatic scoring register. The bull's-eye section of the target portion includes two target plates to define two scoring areas with two different score values.

5 Claims, 7 Drawing Sheets

DART GAME

BACKGROUND OF THE INVENTION

1. Field of the Invention

This invention relates to a dart game, and more particularly to an improved dart game having a dart board which has two scoring areas of two different score values in the bull's-eye section.

2. Description of the Related Art

A conventional dart game includes a dart and a dart board. The dart board includes a base plate and a target frame fixed to the base plate to define a hollow space therebetween. The target frame has a target portion including concentric annular ribs and angularly spaced radial ribs which intersect the annular ribs to form a plurality of spaced scoring areas of different score values. An innermost one of the annular ribs forms a central circular scoring area which defines a bull's-eye section. The target frame further has a plurality of target plates of different shapes corresponding with and respectively disposed in the scoring areas, mounted between the ribs, and shiftable toward the base plate. The dart board further includes an automatic scoring register. The automatic scoring register includes a flat panel mounted in the hollow space and attached to the base plate. The flat panel has a plurality of touch-activated switches provided thereon which are arranged in accordance with the target plates, a circuit means is mounted in the hollow space and electrically connected to the touch-activated switches and a display unit is mounted on the target frame which is electrically connected to the circuit means. A particular one of the target plates is urged to impact one of the touch-activated switches so as to cause the circuit means to control the display unit to show a score which corresponds to the particular one of the target plates when the dart strikes the particular one of the target plates. The bull's-eye section in this conventional dart game has only one scoring area with one score value.

SUMMARY OF THE INVENTION

Therefore, the object of this invention is to provide an improved dart game having a dart board which has two scoring areas with two different score values in the bull's-eye section, thereby making the game more challenging.

Accordingly, a dart game of this invention includes a dart and a dart board. The dart board includes a base plate and a target frame fixed to the base plate to define a hollow space therebetween. The target frame has a target portion including concentric annular ribs and angularly spaced radial ribs which intersect the annular ribs to form a plurality of spaced scoring areas of different score values. An innermost one of the annular ribs forms a central circular scoring area which defines a bull's-eye section. The target frame further has a plurality of target plates of different shapes corresponding with and respectively disposed in the scoring areas, mounted between the ribs, and shiftable toward the base plate. The dart board further includes an automatic scoring register. The automatic scoring register includes a flat panel mounted in the hollow space and attached to the base plate. The flat panel has a plurality of touch-activated switches provided thereon and arranged in accordance with the target plates. The dart board includes a circuit means mounted in the hollow space and electrically connected to the touch-activated switches and a display unit mounted on the target frame which is electrically connected to the circuit means. A particular one of the target plates is urged to impact one of the touch-activated switches so as to cause the circuit means to control the display unit to show a score which corresponds to the particular one of the target plates when the dart strikes the particular one of the target plates.

The target frame includes an annular support member which is fixed to the target portion at the central circular scoring area and which defines an annular clearance with the innermost one of the annular ribs, an inner circular target plate mounted in the annular support member and which is shiftable toward the base plate, and an outer annular target plate mounted in the annular clearance and which is shiftable toward the base plate. The inner circular target plate and the outer annular target plate define two different scoring areas in the bull's-eye section.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figures 1, 2:
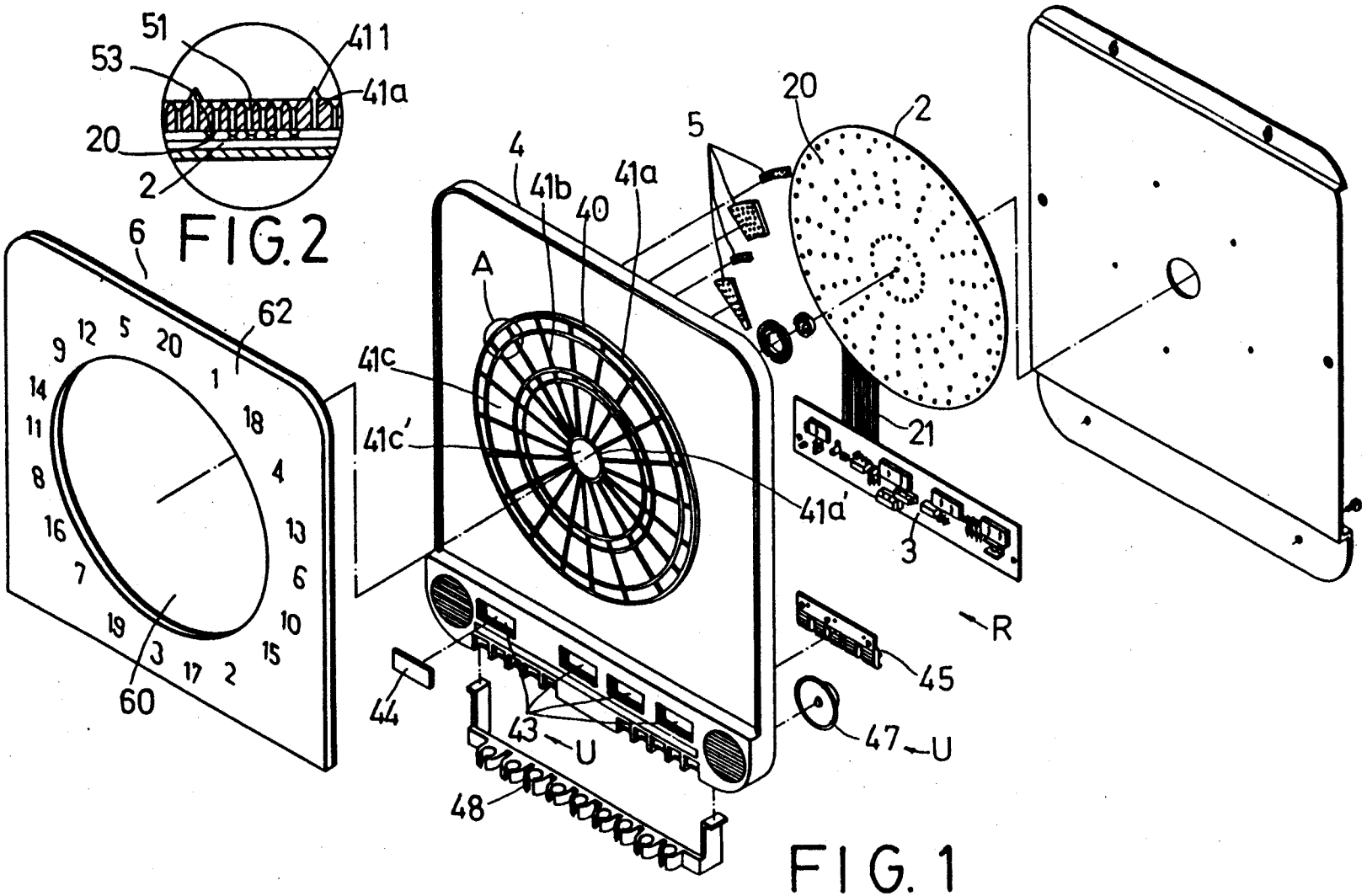
FIG. 1 is an exploded view of a first preferred embodiment of the improved dart game of this invention.
FIG. 2 is a partial sectional view of the target portion indicated by the circle A in FIG. 1.
Figure 3:
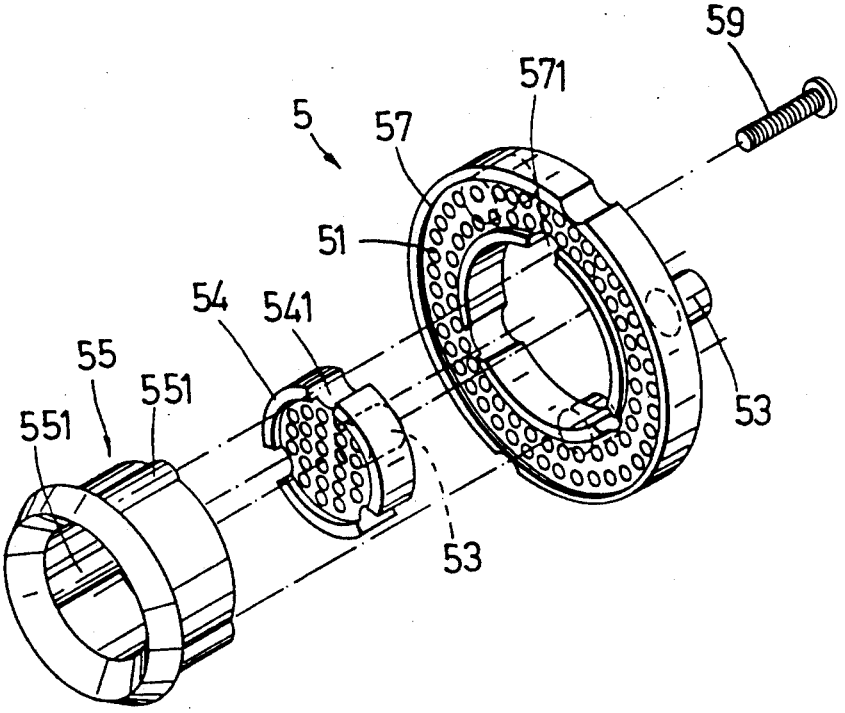
FIG. 3 is an exploded view of a central circular scoring area of the target frame of the first preferred embodiment.
Figure 4:
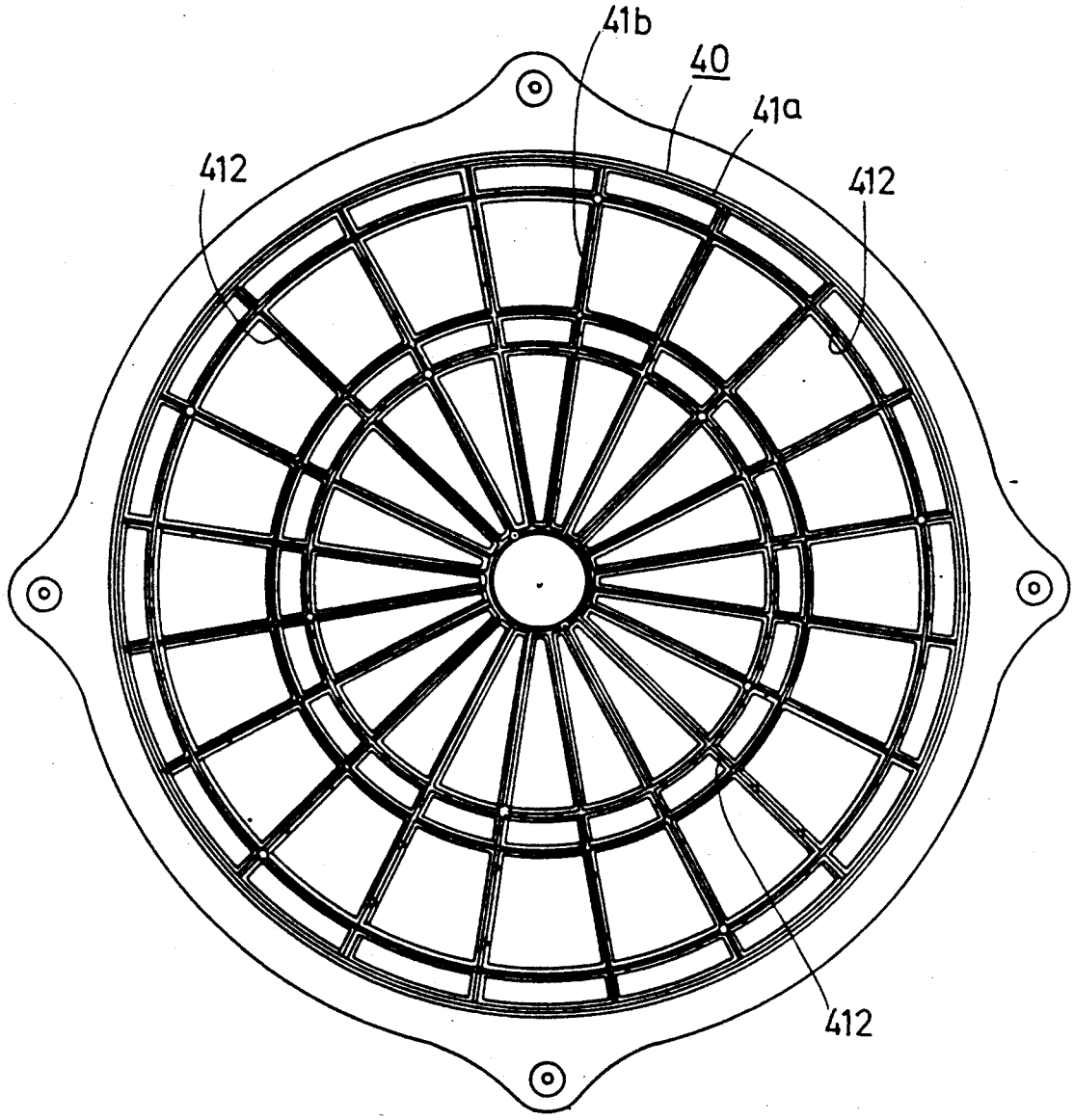
FIG. 4 is a front view of the target portion of the first preferred embodiment.

Referring to FIGS. 1 to 7, a first preferred embodiment of an improved dart game of this invention includes darts (7) with plastic tips and a dart board (D). The dart board (D) includes a base plate (1) and a target frame (4) fixed to the base plate (1) to (4) has a target portion (40), including concentric annular ribs (41*a*) and angularly spaced radial ribs (41*b*) which intersect the annular ribs (41*a*) to form a plurality of spaced scoring areas (41*c*) of different score values. An innermost annular rib (41*a'*) forms a central circular scoring area (41*c'*)

which defines a bull's-eye section. Each of the annular and radial ribs (41*a*, 41*b*) has projecting studs (412) extending therefrom, as indicated in FIG. 4. Referring to FIG. 2, each of the annular and radial ribs (41*a*, 41*b*) has an enlarged front portion (411). The target frame (4) further has a plurality of target plates (5) of different shapes corresponding with and respectively disposed in the scoring areas (41*c*). The target plates (5) are mounted between the ribs (41*a*, 41*b*) and abut the enlarged front portion (411) to prevent untimely detachment from the target frame (4). The target plates (5) contact the projecting studs (412) and are shiftable rearwardly toward the base plate (1) along the projecting studs (412) with reduced friction.

Figure 5A:
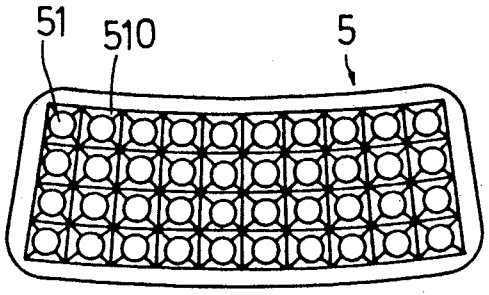
FIG. 5(A) is a front view of the target plate of the first preferred embodiment.
Figure 5C:
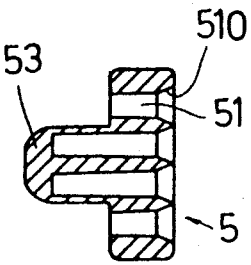
FIG. 5(C) is a sectional view taken along the line Z—Z in the FIG. 5(B)
Figure 5B:
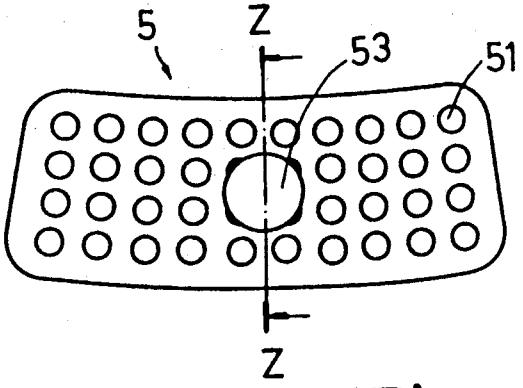
FIG. 5(B) is a rear view of the target plate in FIG. 5(A)
Figure 7:
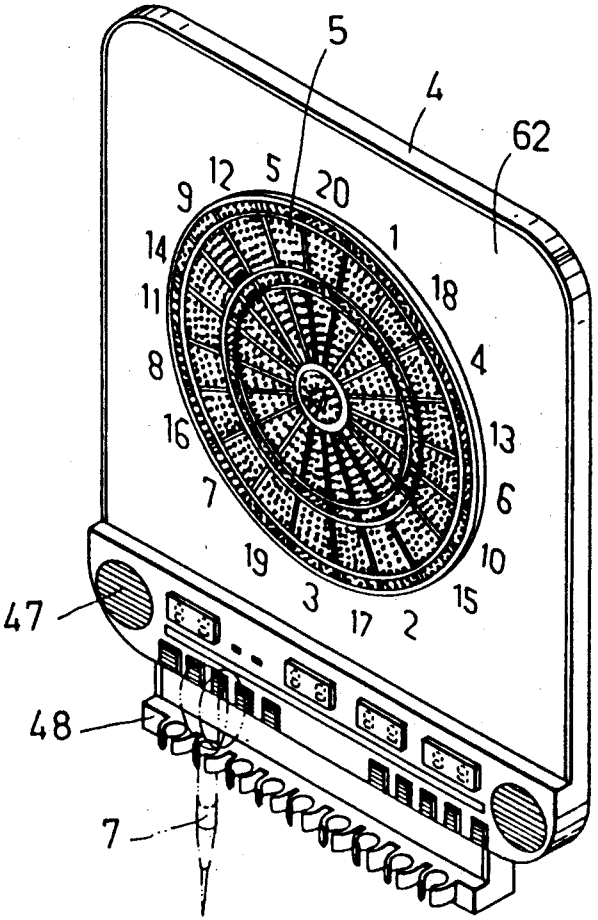
FIG. 7 is a perspective view of the first preferred embodiment.

Referring to FIGS. 5(A) to 5(C), each of the target plates (5) has a plurality of blind counterbores (51) formed thereon for receiving the dart (7). Each of the blind counterbores (51) includes an enlarged outer end formed with four inwardly tapered bevels (510) and a constricted inner end. Two adjacent blind counterbores (51) share a common peripheral edge on a front side of a respective one of the target plates (5). Only narrow peripheral edges are left between the blind counterbores (51). A dart (7) which strikes one of the target plates (5) tends to slide into one of the blind counterbores (51) rather than bounces away. Therefore, the blind counterbores (51) effectively capture the dart (7). In addition, each of the target plates (5) has at least one projecting stud (53) extending rearwardly toward the base plate (1). The number of projecting studs (53) on each target plate (5) corresponds to the area of the same.

The target frame (4) further includes an annular support member (55) which is fixed to the target portion (40) at the central circular scoring area (41*c*') by screws (59) and which defines an annular clearance with the innermost annular rib (41*a*'). The annular support member (55) has inner and outer elongated protrusions (551) extending inward and outward respectively and angularly spaced from one another. An inner circular target plate (54) is mounted in the annular support member (55) and has outer elongated grooves (541) which are angularly spaced from one another and which engage the inner protrusions (551). The inner circular target plate (54) is shiftable toward the base plate (1). An outer annular target plate (57) is mounted in the annular clearance between the annular support member (55) and the innermost annular rib (41*a*') and has inner elongated grooves (571) formed thereon which are angularly spaced from one another and which engage the outer protrusions (551). The outer annular target plate (57) is shiftable toward the base plate (1). Therefore, the inner circular target plate (54) and the outer annular target plate (57) define two scoring areas with two different score values in the bull's-eye section. This can make the game more challenging.

The dart board (D) further includes an automatic scoring register (R). The automatic scoring register (R) includes a flat panel (2) which is mounted in the hollow space between the base plate (1) and the target frame (4) and which is attached to the base plate (1). The flat panel (2) has a plurality of membrane switches (20) provided thereon which are arranged in accordance with the target plates (5). A circuit means (3), which includes a central processing unit, is mounted in the hollow space and is electrically connected to the membrane switches (20) by a bus (21). A display unit (U) includes four screens (43) covered with protecting covers (44) and two loud speakers (47). All of the screens (43) and the loud speakers (47) are electrically connected to and controlled by the circuit means (3). A switch unit (45), which has switch buttons, is mounted on the target frame (4) and is electrically connected to the circuit means (3).

A numeral panel (6) has a central hole (60) corresponding with the target portion (40), a plurality of angularly spaced numeral markings formed thereon and a protecting cover (62) covered thereon. The protecting cover (62) is made of a high density polymer material. The numeral panel (6) is mounted to the target frame (4) around the target portion (40).

A dart holding member (48) is mounted on the bottom end of the target frame (4) to hold the darts (7) when they are not in use.

Figure 6:
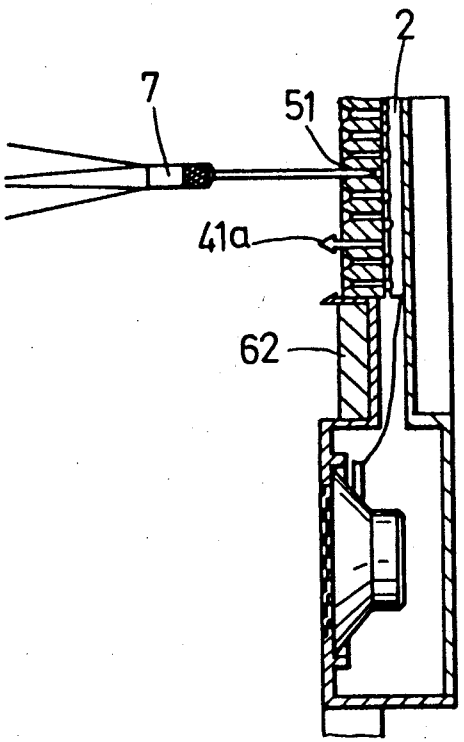
FIG. 6 shows that a dart with a plastic tip strikes the target portion of the first preferred embodiment.
Figures 8, 9:
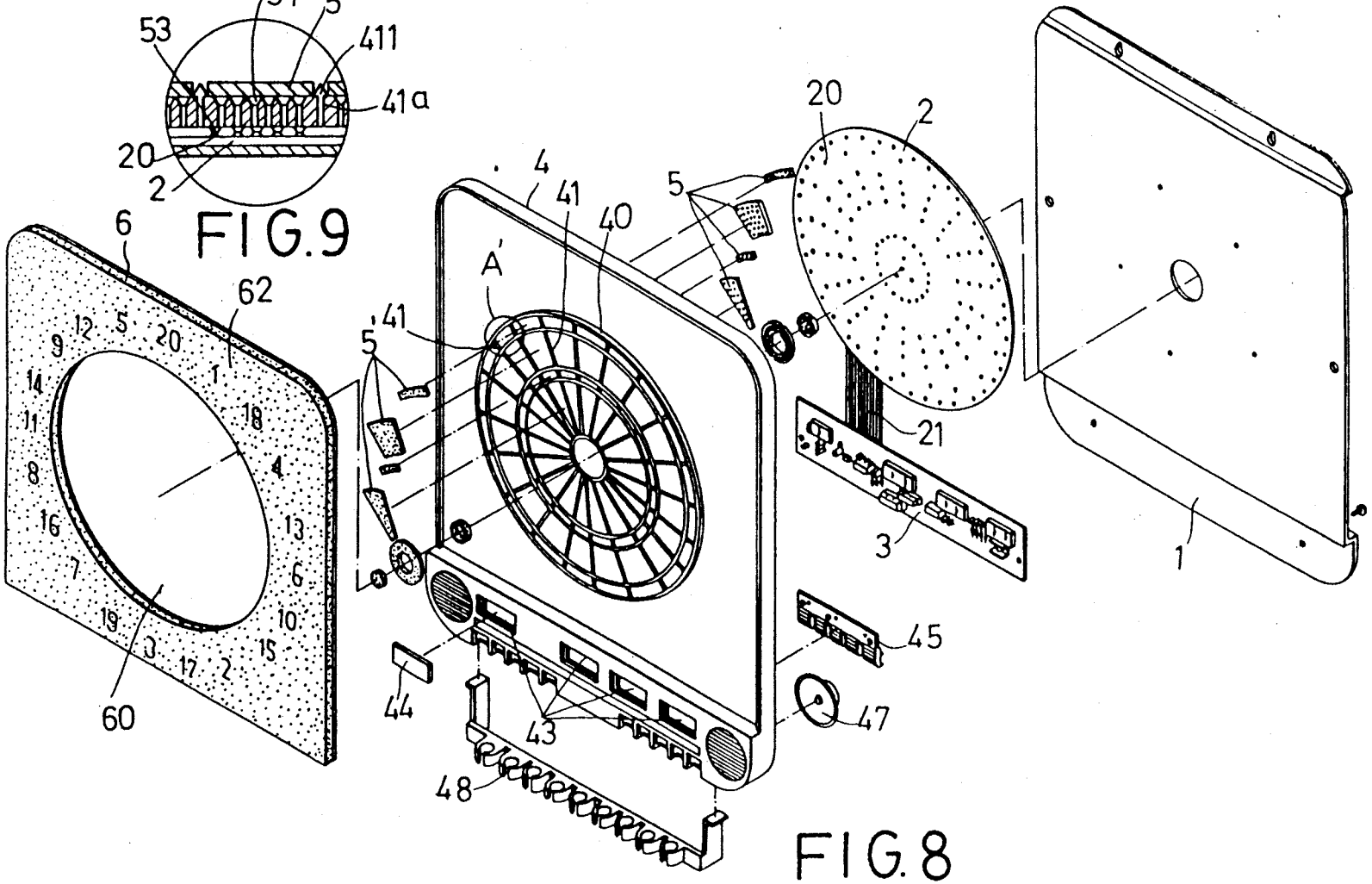
FIG. 8 is an exploded view of a second preferred embodiment of the improved dart game of this invention.
FIG. 9 is a partial sectional view of the target portion indicated by the circle A' in FIG. 8.
Figure 11:
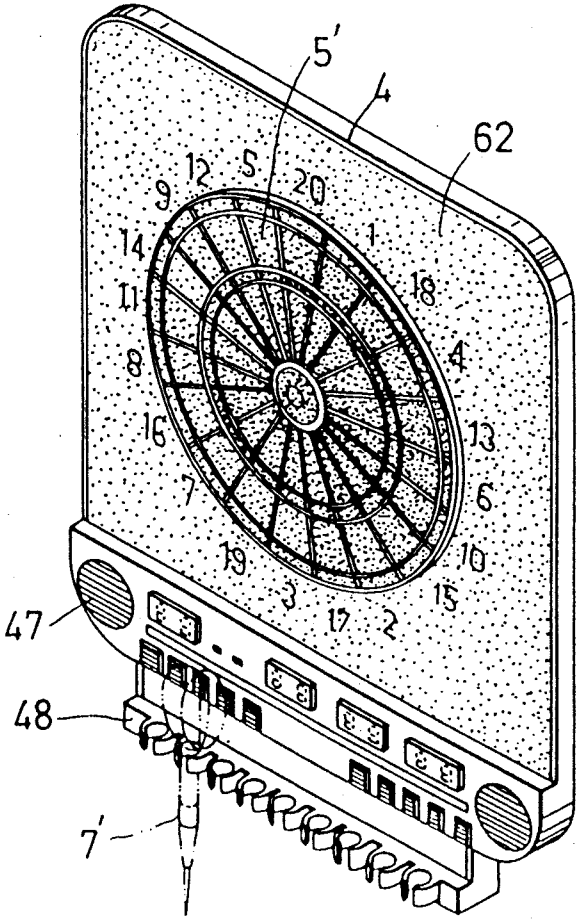
FIG. 11 is a perspective view of the second preferred embodiment.
Figure 10:
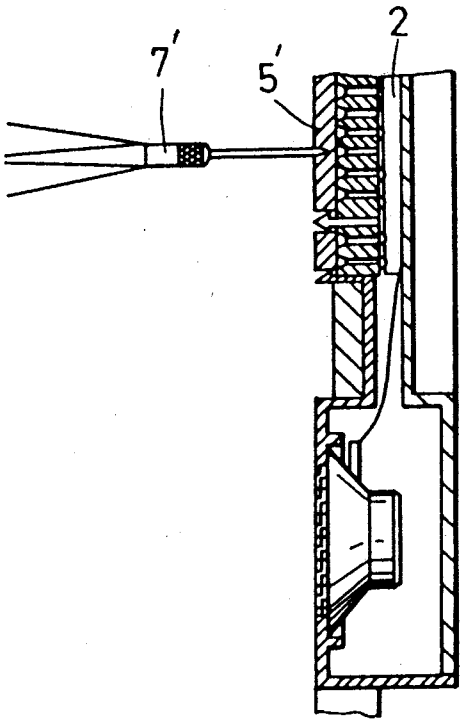
FIG. 10 shows a dart with a metal tip which strikes the target portion of the second preferred embodiment.

The switch unit (45) is first turned on when the dart game of this invention is to be used. Referring to FIG. 6, a particular one of the target plates (5) is urged to shift inwardly toward the flat panel (2), and one of the studs (53) of the particular one of the target plates (5) momentarily impacts one of the membrane switches (20) when the dart (7) strikes the particular one of the target plates (5) and engages into one of the blind counterbores (51). The circuit means (3) is caused to control the screens (43) to show a score which corresponds to the particular one of the target plates (5) and to control the loud speakers (47) to recite the score.

Note that like elements are indicated by the same reference numerals throughout the disclosure. FIGS. 8 to 11 show a second preferred embodiment of this invention. The second preferred embodiment further includes a plurality of high density polymer plates (5') with detachable adhesive faces to be provided on a front side of a respective one of the target plates (5). The second preferred embodiment has a dart (7') with a metal tip to pierce into one of the high density polymer plates (5').

While the present invention has been described in connection with what is considered the most practical and preferred embodiment, it is understood that this invention is not limited to the disclosed embodiments, but is intended to cover various arrangements included within the spirit and scope of the broadest interpretations and equivalent arrangements.

I claim:

1. A dart game comprising:

a dart; and a dart board, said dart board including a base plate and a target frame fixed to said base plate to define a hollow space therebetween said target frame having :

a target portion including concentric annular ribs and angularly spaced radial ribs which intersect said annular ribs to form a plurality of spaced scoring areas with different score values, an innermost one of said annular ribs forming a central circular scoring area which defines a bull's-eye section, a plurality of target plates of different shapes corresponding with and respectively disposed in scoring areas, mounted between said ribs, and shiftable toward said base plate; and a plurality of high density polymer plates detachably provided on a front side of a respective one of said plurality of target plates;

said dart board further including:

an automatic scoring register, said automatic scoring register including a flat panel mounted in said hollow space and attached to said base plate, said flat panel having a plurality of touch-activated switches provided thereon which are arranged in accordance with said target plates, a circuit means mounted in said hollow space which is electrically connected to said plurality of touch-activated switches, and a display unit mounted on said target frame which is electrically connected to said circuit means;

a particular one of said plurality of target plates being urged to impact a corresponding one of said plurality of touch-activated switches so as to cause said circuit means to control said display unit to show a score which corresponds to said particular one of said plurality of target plates when said dart strikes said particular one of said plurality of target plates;

said target frame including an annular support member which is fixed to said target portion at said central circular scoring area and which defines an annular clearance with said innermost one of said annular ribs, an inner circular target plate mounted in said annular support member and which is shiftable toward said base plate, and an outer annular target plate mounted in said annular clearance and which is shiftable toward said base plate, said inner circular target plate and said outer annular target plate defining two different scoring areas in said bull's-eye section.

2. The dart game as claimed in claim 1, wherein each of said plurality of target plates is provided with a projecting stud to impact a corresponding one of said plurality of said touch-activated switches.

3. The dart game as claimed in claim 1, wherein each of said plurality of target plates has a plurality of blind counterbores formed thereon for receiving said dart, each of said plurality of blind counterbores having an enlarged outer end formed with four inwardly tapered bevels and a constricted inner end, two adjacent ones of said plurality of blind counterbores sharing a common peripheral edge on a front side of a respective one of said plurality of target plates.

4. A dart game as claimed in claim 1, characterized in that each of said annular and radial ribs has a plurality of studs protruding therefrom to contact one of said target plates.

5. A dart game as claimed in claim 1, further including a dart holding member mounted on said target frame to hold said dart when said dart is not in use.

* * * * *